US005513723A

United States Patent [19]

Luebke

[11] Patent Number: 5,513,723

[45] Date of Patent: May 7, 1996

[54] DOUBLE-MASTED CRANE WITH IMPROVED BRAKE ARRANGEMENT

[75] Inventor: Roger D. Luebke, Hartford, Wis.

[73] Assignee: Harnischfeger Corporation, Brookfield, Wis.

[21] Appl. No.: 269,894

[22] Filed: Jul. 1, 1994

[51] Int. Cl.[6] ..... B66B 9/16

[52] U.S. Cl. ..... 187/244; 187/252; 187/262; 187/373; 187/393

[58] Field of Search ..... 187/254, 252, 187/244, 261, 262, 359, 373, 376, 393

[56] References Cited

U.S. PATENT DOCUMENTS

| | | | |
|---|---|---|---|
| 1,062,611 | 5/1913 | Schnur | 187/373 X |
| 2,150,373 | 3/1939 | Hymans | 187/376 |
| 3,695,396 | 10/1972 | Jones | 187/373 |
| 4,372,426 | 2/1983 | Gamundi | 187/244 X |
| 4,662,481 | 5/1987 | Morris et al. | 187/373 |
| 5,052,523 | 10/1991 | Ericson | 187/373 X |
| 5,301,773 | 4/1994 | Jamieson et al. | 187/376 |

FOREIGN PATENT DOCUMENTS

| | | | |
|---|---|---|---|
| 2182604 | 7/1990 | Japan | 187/244 X |

*Primary Examiner*—William E. Terrell
*Assistant Examiner*—Dean A. Reichard
*Attorney, Agent, or Firm*—Michael, Best & Friedrich

[57] ABSTRACT

Lifting apparatus comprising first and second generally vertical masts, an assembly including a frame moveable along the masts, and a load engaging mechanism mounted on the frame, a first brake mechanism which, upon actuation, engages the first mast to prevent downward movement of the frame relative to the first mast, a second brake mechanism which, upon actuation, engages the second mast to prevent downward movement of the frame relative to the second mast, an overspeed mechanism for sensing the downward velocity of the assembly and for actuating the first brake mechanism when the overspeed mechanism senses that the downward velocity of the assembly exceeds a predetermined value, a first electrical device for providing an electrical signal when the first brake mechanism is actuated, and a second electrical device for actuating the second brake mechanism in response to the electrical signal.

19 Claims, 3 Drawing Sheets

230VAC

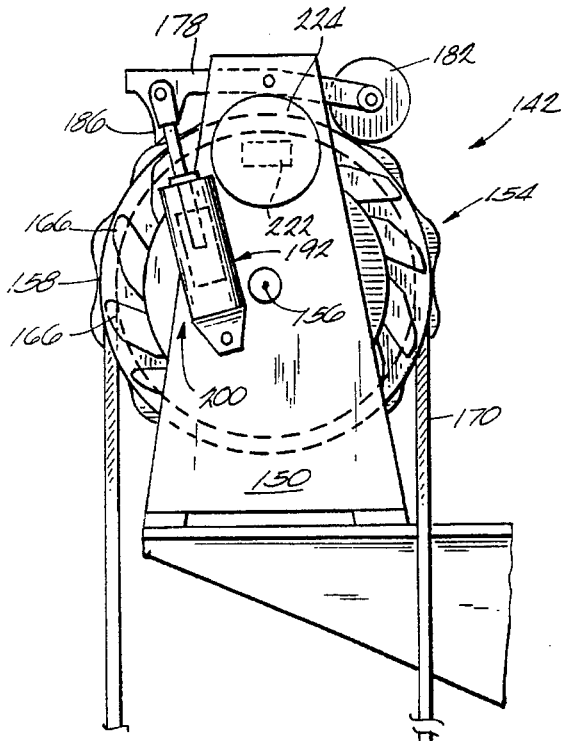
Fig. 3
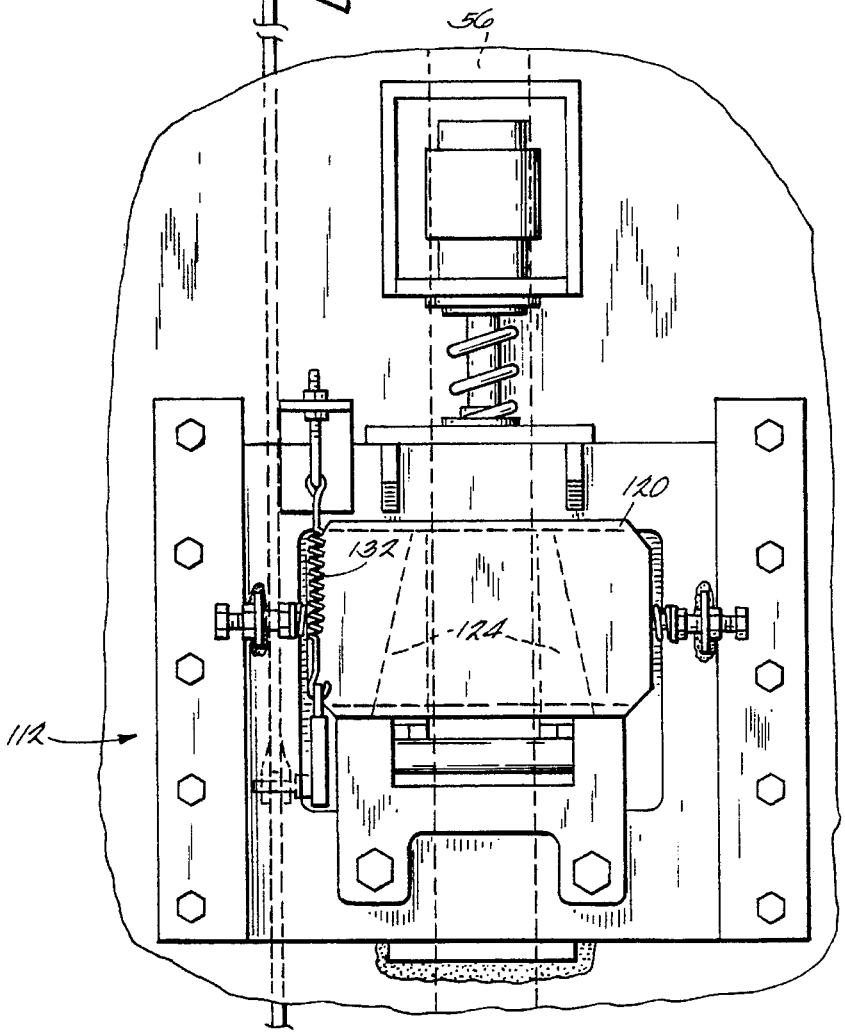

DOUBLE-MASTED CRANE WITH IMPROVED BRAKE ARRANGEMENT

BACKGROUND OF THE INVENTION

The invention relates to a lifting apparatus comprising at least two masts and a load engaging mechanism moveable vertically along the masts. More particularly, the invention relates to brake mechanisms for preventing either the operator's cab or the load of such an apparatus from accidentally dropping. Still more particularly, the invention relates to cranes.

A conventional double-masted crane has two masts supported either from above (such as by a trolley moving along a bridge) or from below (such as by a base moving along rails on the ground). An operator's cab is mounted on the masts for housing an operator controlling the crane. A load engaging mechanism, such as a shuttle mechanism or a pair of forks, moves with the cab. The load engaging mechanism is raised and lowered by a hoist assembly.

This type of crane typically includes, on each of the two masts, a brake mechanism for preventing undesirable or uncontrolled downward movement of the operator's cab or the load relative to the masts. A brake mechanism includes a brake member which is supported by a housing mounted on the mast and which engages the mast to prevent downward movement of the cab relative to the mast. An overspeed mechanism causes the brake member to engage the mast when the downward velocity of the cab relative to the mast exceeds a predetermined value.

SUMMARY OF THE INVENTION

A disadvantage of known braking arrangements for double-masted cranes is that the two brake mechanisms do not always engage simultaneously or near simultaneously, so that the cab or load engaging mechanism becomes cocked and jammed between the masts. The invention provides a double-masted lifting apparatus, such as a crane, with an improved brake arrangement that overcomes this disadvantage by providing simultaneous or near simultaneous engagement of the two brake mechanisms.

More particularly, the invention provides a crane comprising first and second generally vertical masts and a cab or carriage assembly including a frame moveable along the masts, and a load engaging mechanism mounted on the frame. The crane also comprises a first brake mechanism which, upon actuation, engages the first mast to prevent downward movement of the cab assembly relative to the first mast, and a second brake mechanism which, upon actuation, engages the second mast to prevent downward movement of the cab assembly relative to the second mast. The brake mechanisms are preferably identical and can be conventional. The crane further comprises a first overspeed mechanism for sensing the downward velocity of the cab assembly and for actuating the first brake mechanism when the first overspeed mechanism senses that the downward velocity of the cab assembly exceeds a predetermined value, and a second overspeed mechanism for sensing the downward velocity of the cab assembly and for actuating the second brake mechanism when the second overspeed mechanism senses that the downward velocity of the cab assembly exceeds a predetermined value. Each overspeed mechanism includes a rocker member moveable between actuating and non-actuating positions. When the rocker member moves to its actuating position, the overspeed mechanism actuates the associated brake mechanism. The rocker member is normally in its non-actuating position and moves to its actuating position when the overspeed mechanism senses that the downward velocity of the cab assembly is excessive, i.e., when the overspeed mechanism is tripped. The overspeed mechanisms as thus far described are conventional.

Each overspeed mechanism has thereon a solenoid connected to the associated rocker member such that energization of the solenoid causes movement of the rocker member to its actuating position, thereby tripping the overspeed mechanism and actuating the associated brake mechanism. Also, each overspeed mechanism includes a normally-open switch that closes when the overspeed mechanism is tripped, and the closing of the switch energizes the other solenoid to thereby move the other rocker member to its actuating position, thereby tripping the other overspeed mechanism and actuating the other brake mechanism. Thus, the two brake mechanisms are actuated almost simultaneously when either of the overspeed mechanisms actuates the associated brake mechanism.

Other features and advantages of the invention will become apparent to those skilled in the art upon review of the following detailed description, claims and drawings.

DESCRIPTION OF THE DRAWINGS

FIG. 3 is an enlarged, partial view of an overspeed mechanism and a brake mechanism.

Figures 1, 2, 5:
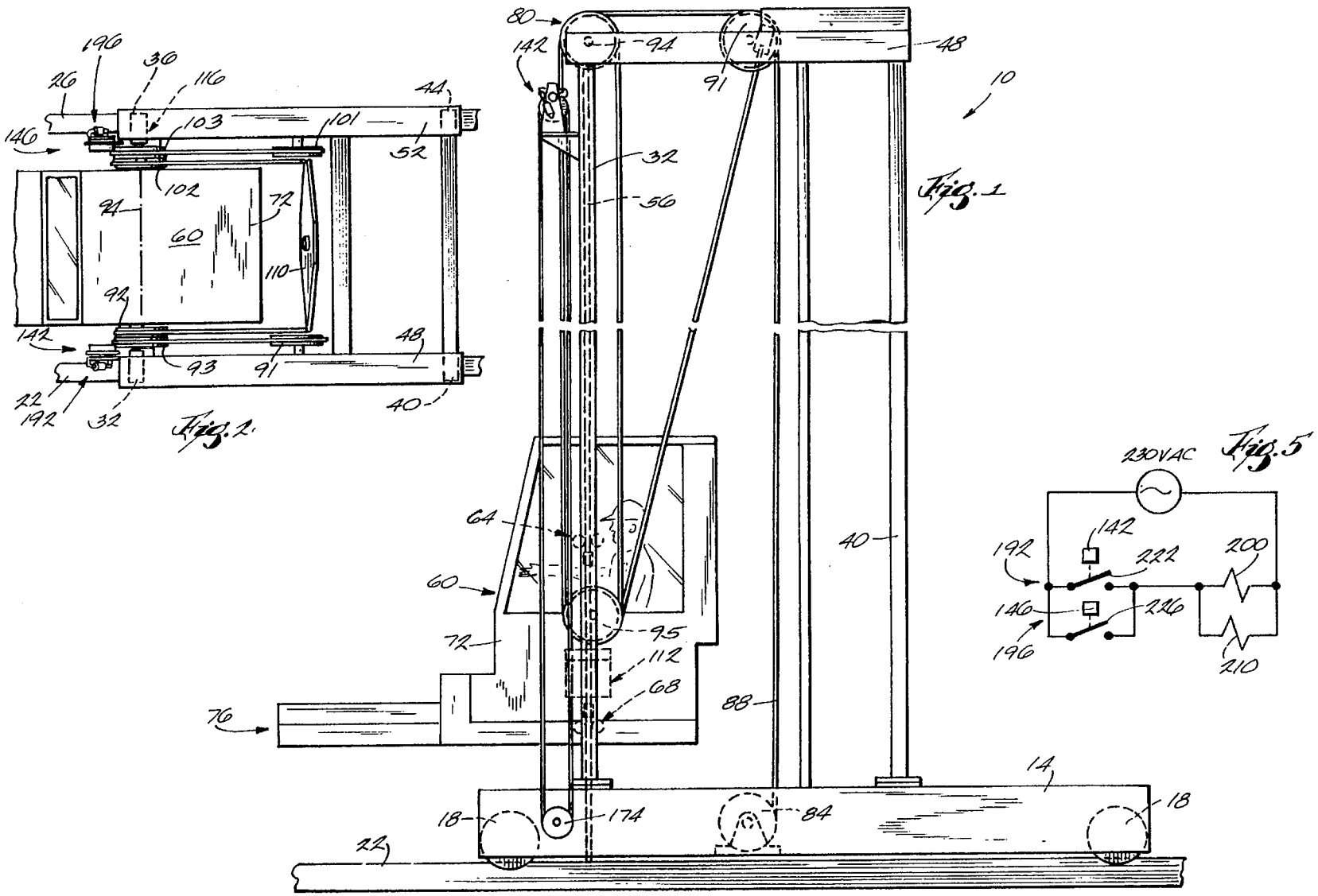
FIG. 1 is a side elevational view of a crane embodying the invention.
FIG. 2 is a partial top view of the crane.
FIG. 5 illustrates the electrical circuit connecting the overspeed mechanisms.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A lifting apparatus embodying the invention is illustrated in the drawings. While the illustrated lifting apparatus is a floor-running crane 10, it should be understood that the invention is applicable to any type of double-masted lifting apparatus.

The crane 10 comprises (see FIG. 1) a base 14 supported by wheels 18 for movement along a pair of rails 22 and 26 (see FIG. 2). Generally vertical front masts 32 and 36 and generally vertical rear masts 40 and 44 extend upwardly from the base 14. The upper ends of the masts 32, 36, 40 and 44 are connected by an upper frame including spaced frame members 48 and 52. Each of the front masts 32 and 36 has on the inner side thereof a generally vertical rail 56 (see FIGS. 1 and 3).

A cab or carriage assembly 60 (see FIG. 1) is moveable vertically along the front masts 32 and 36. More particularly, each side of the cab assembly 60 is supported by upper and lower roller assemblies 64 and 68 for movement along the adjacent rail 56. The cab assembly 60 includes a cab frame 72 on which the roller assemblies 64 and 68 are mounted. The cab frame 72 has left and right sides (lower and upper sides, respectively, in FIG. 2). A load engaging mechanism 76 (shown schematically in FIG. 1) is mounted on the frame. Any type of load engaging mechanism can be employed. In the preferred embodiment, the load engaging mechanism 76 is a shuttle device for moving loads onto and off of racks (not shown) on either side of the rails 22 and 26.

The crane 10 also comprises (see FIG. 1) a hoist mechanism 80 for moving the cab assembly 60 vertically along the masts 32 and 36. The hoist mechanism 80 includes a hoist drum 84 mounted on the base 14 such that the axis of rotation of the drum 84 is fixed relative to the masts 32 and 36. A hoist rope 88 is wound around the drum 84. The hoist mechanism 80 also includes a rear upper sheave 91 rotatably mounted on the upper frame member 48, and front inner and outer left upper sheaves 92 and 93 mounted on the upper frame member 48 for rotation about a common axis 94. Front inner and outer left lower sheaves 95 (one is shown in FIG. 1) are rotatably mounted on the left side of the cab frame 72. The hoist mechanism 80 also includes (see FIG. 2) a rear upper sheave 101 mounted on the frame member 52, and front inner and outer right upper sheaves 102 and 103 mounted on the frame member 52 for rotation about the axis 94. Front inner and outer right lower sheaves (not shown) are mounted on the right side of the cab frame 72. One portion of the hoist rope 88 extends upwardly from the drum 84, over the rear upper sheave 91, over the front outer sheave 93, downwardly around the lower left outer sheave 95, upwardly around the upper inner sheave 92, downwardly around the lower left inner sheave 95, and upwardly to one end of an equalizer bar 110 mounted on the upper frame. Another portion of the hoist rope 88 extends upwardly from the drum 84, over the rear upper sheave 101, over the front outer sheave 103, downwardly around the lower right outer sheave, upwardly around the upper inner sheave 102, downwardly around the lower right inner sheave, and upwardly to the other end of the equalizer bar 110. Thus, rotation of the drum 84 in one direction moves the lower sheaves and the cab assembly 60 upwardly, and rotation of the drum 84 in the other direction moves the lower sheaves and the cab assembly 60 downwardly.

The crane 10 further comprises (see FIGS. 1 and 3) a first brake mechanism 112 which is mounted on the left side of the cab frame 72 and which, upon actuation, engages the rail 56 on the mast 32 to prevent downward movement of the cab frame 72 relative to the mast 32. A second brake mechanism 116 (see FIG. 2) is mounted on the right side of the cab frame 72 and, upon actuation, engages the rail 56 on the mast 36 to prevent downward movement of the cab frame 72 relative to the mast 36. The brake mechanisms 112 and 116 are preferably mirror images of each other and are substantially identical to the brake mechanism disclosed in U.S. application Ser. No. 195,120, which was filed Feb. 14, 1994, which is titled "Stacker Crane with Improved Brake Mechanism", which is assigned to the assignee hereof, and which is incorporated herein by reference.

Each of the brake mechanisms 112 and 116 includes (see FIG. 3) a housing 120 mounted on the cab frame 72 and a pair of wedgeshaped brake members 124 which are supported by the housing 120 for movement between engaged and disengaged positions and which, upon actuation of the brake mechanism, engage the associated rail 56 to prevent downward movement of the housing 120 and the cab frame 72 relative to the associated mast. Each of the brake mechanisms 112 and 116 also includes a lever 128 which is pivotally mounted on the housing 120, which is operably connected to the brake members 124 and which is moveable between engaged and disengaged positions respectively corresponding to the engaged and disengaged positions of the brake members 124. A spring 132 biases the lever 128 to its disengaged position so that the brake members 124 are normally out of engagement with the associated rail 56.

Figure 4:
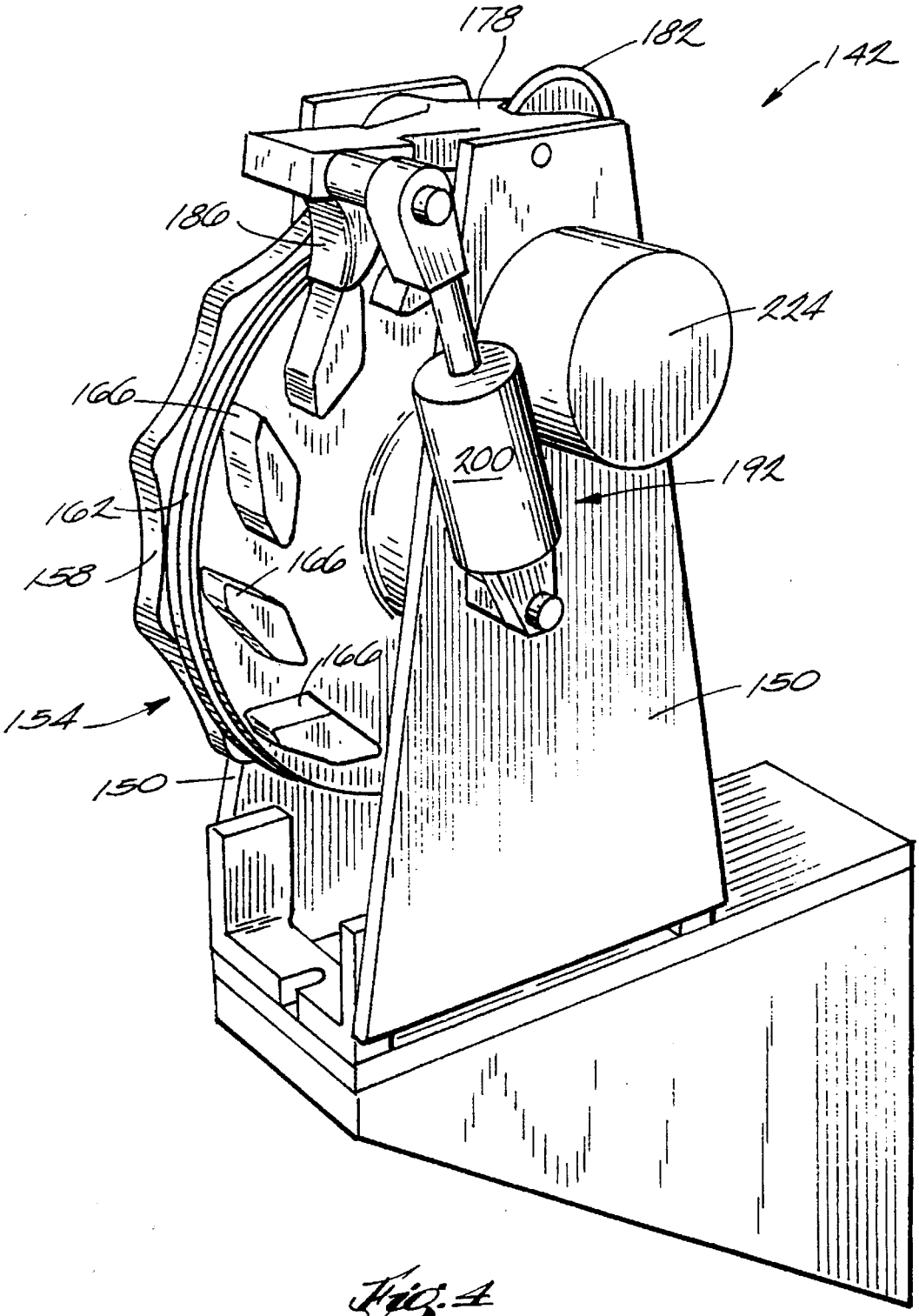
FIG. 4 is a perspective view of the overspeed mechanism.

The crane 10 further comprises (see FIGS. 3 and 4) an overspeed mechanism 142 mounted on the mast 32 adjacent the upper end thereof, and an overspeed mechanism 146 (see FIG. 2) mounted on the mast 36 adjacent the upper end thereof. The overspeed mechanism 142 senses the downward velocity of the cab assembly 60 and actuates the brake mechanism 112 when the overspeed mechanism senses that the downward velocity of the cab assembly 60 exceeds a predetermined value (preferably approximately 40% above the normal lowering speed). The overspeed mechanism 146 senses the downward velocity of the cab assembly 60 and actuates the brake mechanism 116 when the overspeed mechanism 146 senses that the downward velocity of the cab assembly 60 exceeds the predetermined value. The overspeed mechanisms 142 and 146 are preferably mirror images of each other, and only the overspeed mechanism 142 will be described in detail. Common elements have been given the same reference numerals.

The overspeed mechanism 142 includes (see FIGS. 3 and 4) a mounting frame which includes spaced, generally vertical plates 150. A cam/sheave/ratchet assembly 154 is mounted between the plates 150 for rotation about a generally horizontal axis 156 (see FIG. 3). The cam/sheave/ratchet assembly 154 includes (see FIG. 4) a cam portion providing an endless cam surface 158 centered on the axis 156, a sheave portion providing a rope grove 162 centered on the axis 156, and a ratchet portion which is centered on the axis 156 and which includes ratchet teeth 166. The overspeed mechanism 142 also includes (see FIG. 3) a rope or trip line 170 reeved around the sheave portion (in the rope groove 162) and also reeved around a lower sheave 174 (see FIG. 1) rotatably mounted on the base 14. The trip line 170 is, as is known in the art, connected to the lever 128 of the brake mechanism 112 such that upward and downward movement of the brake mechanism 112 with the cab assembly 60 causes the trip line 170 to move upwardly and downwardly and thereby rotate the cam/sheave/ratchet assembly 154 and the lower sheave 174.

The overspeed mechanism 142 also includes (see FIGS. 3 and 4) a rocker member 178 mounted between the plates 150 for pivotal movement about a generally horizontal axis above the cam/sheave/ratchet assembly 154. One end of the rocker member 178 (the right end in FIG. 3) has thereon a cam follower 182 which rolls along the cam surface 158 and which moves upwardly and downwardly in response to the changing contour of the cam surface 158. The opposite end of the rocker member 178 has thereon a downwardly extending pawl 186. The rocker member 178 is moveable between a disengaged position (shown in FIG. 3) in which the pawl 186 is out of engagement with the ratchet teeth 166 such that the cam/sheave/ratchet assembly 154 is free to rotate, and an engaged position in the which the pawl 186 engages the ratchet teeth 166 and thereby prevents rotation of the cam/sheave/ratchet assembly 154. The rocker member 178 is normally in its disengaged position.

As the cab assembly 60 is raised and lowered, the trip line 170 causes rotation of the cam/sheave/ratchet assembly 154 as described above. The cam follower 182 follows the contour of the cam surface 158, causing the pawl 186 to move up and down over the ratchet teeth 166. As long as the lowering speed of the cab assembly 60 is not excessive, the pawl 186 does not move downwardly far enough to engage the ratchet teeth 166. When the lowering speed of the cab assembly 60 exceeds the predetermined limit, the higher rotational speed of the cam surface 158 causes the cam follower 182 to move upwardly far enough so that the pawl 186 moves downwardly into engagement with the ratchet teeth 166. This stops rotation of the cam/sheave/ratchet assembly 154 and thereby stops movement of the trip line 170. Thereafter, downward movement of the brake mechanism 112 relative to the trip line 170 moves the lever 128 from its disengaged position to its engaged position, thereby moving the brake members 124 into engagement with the rail 56 and stopping downward movement of the cab assembly 60 relative to the mast 32.

The operation of the overspeed mechanisms 142 and 146 and the brake mechanisms 112 and 116 as thus far described is conventional and will not be described in greater detail. The overspeed mechanisms 142 and 146 as thus far described are preferably manufactured by Hans Jungblut of Germany and sold under the name Geschwindigkeitsbegrenzer.

The crane 10 further comprises (see FIGS. 3–5) a first electrical device 192 for providing a first electrical signal when the brake mechanism 112 is actuated, and for actuating the brake mechanism 112 in response to a second electrical signal, and a second electrical device 196 (see FIGS. 2 and 5) for actuating the brake mechanism 116 in response to the first electrical signal, and for providing the second electrical signal when the brake mechanism 116 is actuated. Preferably, the first electrical device 192 causes the overspeed mechanism 142 to actuate the brake mechanism 112 in response to the second electrical signal, and the second electrical device 196 causes the overspeed mechanism 146 to actuate the brake mechanism 116 in response to the first electrical signal. Furthermore, the first electrical device 192 provides the first electrical signal when the brake mechanism 112 is actuated in response to the overspeed mechanism 142 sensing excessive downward velocity of the cab assembly 60, and the second electrical device 196 provides the second electrical signal when the brake mechanism 116 is actuated in response to the overspeed mechanism 146 sensing excessive downward velocity of the cab assembly 60. The electrical devices 192 and 196 are preferably substantially identical.

The electrical device 192 includes (see FIGS. 4 and 5) a solenoid 200 connected between the pawl 186 of the overspeed mechanism 142 and the mounting frame of the overspeed mechanism 142. Upward and downward movement of the pawl 186 causes extension and contraction of the solenoid 200. Conversely, contraction (energization) of the solenoid 200 causes downward movement of the pawl 186 into engagement with the ratchet teeth 166 of the overspeed mechanism 146. Assuming the brake mechanism 112 is not engaged, energization of the solenoid 200 by the second electrical signal moves the pawl 186 into engagement with the ratchet and thus actuates the brake mechanism 112. The electrical device 192 also includes (see FIGS. 3 and 5) a normally-open switch 222 operably connected to the overspeed mechanism 142 such that the switch 222 is closed when the overspeed mechanism 142 is tripped, i.e., when the pawl 186 of the overspeed mechanism 142 engages the ratchet teeth 166. The switch 222 can be operably connected to the overspeed mechanism 142 in any suitable manner. The switch 222 is preferably housed beneath the same cover 224 (see FIGS. 3 and 4) that houses a conventional normally-closed switch (not shown) that opens when the overspeed mechanism 142 is tripped.

The electrical device 196 includes (see FIG. 5) a solenoid 210 connected between the pawl 186 of the overspeed mechanism 146 and the mounting frame of the overspeed mechanism 146. Upward and downward movement of the pawl 186 causes extension and contraction of the solenoid 210. Conversely, contraction (energization) of the solenoid 210 causes downward movement of the pawl 186 into engagement with the ratchet teeth 166 of the overspeed mechanism 146. Assuming the brake mechanism 116 is not engaged, energization of the solenoid 210 by the second electrical signal moves the pawl 186 into engagement with the ratchet and thus actuates the brake mechanism 116. The electrical device 196 also includes a normally-open switch 226 operably connected to the overspeed mechanism 146 such that the switch 226 is closed when the overspeed mechanism 146 is tripped, i.e., when the pawl 186 of the overspeed mechanism 146 engages the ratchet teeth 166. The switch 226 can be operably connected to the overspeed mechanism 146 in any suitable manner. The switch 226 is preferably housed beneath the same cover (not shown) that houses a conventional normally-closed switch (not shown) that opens when the overspeed mechanism 146 is tripped.

As illustrated schematically in FIG. 5, the switches 222 and 226 are connected in parallel and in series with the solenoids 200 and 210, which are also connected in parallel. Consequently, closing of either of the switches 222 and 226 energizes both of the solenoids 200 and 210. Thus, when either of the overspeed mechanisms 142 and 146 is tripped, the solenoid connected to the other overspeed mechanism is energized, thereby tripping the other overspeed mechanism.

It should be understood that either overspeed mechanism 142 or 146 and the associated brake mechanism 112 or 116 can be viewed as a single brake arrangement which, upon actuation, prevents downward movement of the cab frame 72 relative to the associated mast, the brake arrangement including a member (the associated lever 128) movable between actuating and non-actuating positions, with energization of the associated solenoid moving the member to its actuating position.

Various features of the invention are set forth in the following claims.

I claim:

1. Lifting apparatus comprising first and second generally vertical masts, an assembly including a frame moveable along said masts, and a load engaging mechanism mounted on said frame, a first brake mechanism which, upon actuation, engages said first mast to prevent downward movement of said frame relative to said first mast, a second brake mechanism which, upon actuation, engages said second mast to prevent downward movement of said frame relative to said second mast, a first overspeed mechanism for sensing the downward velocity of said assembly and for actuating said first brake mechanism when said first overspeed mechanism senses that the downward velocity of said assembly exceeds a first predetermined value, a second overspeed mechanism for sensing the downward velocity of said assembly and for actuating said second brake mechanism when said second overspeed mechanism senses that the downward velocity of said assembly exceeds a second predetermined value, a first electrical device for providing a first electrical signal when said first brake mechanism is actuated, and a second electrical device for providing a second electrical signal when said second brake mechanism is actuated, and for actuating said second brake mechanism in response to said first electrical signal, and said first electrical device actuating said first brake mechanism in response to said second electrical signal.

2. Apparatus as set forth in claim 1 wherein said second electrical device causes said second overspeed mechanism to actuate said second brake mechanism in response to said first electrical signal.

3. Apparatus as set forth in claim 1 wherein said first and second predetermined values are substantially equal.

4. Apparatus as set forth in claim 2 wherein said first electrical device causes said first overspeed mechanism to actuate said first brake mechanism in response to said second electrical signal.

5. Apparatus as set forth in claim 1 wherein said first overspeed mechanism includes a member movable between actuating and non-actuating positions, wherein movement of said member to said actuating position actuates said first brake mechanism, wherein said member moves to said actuating position in response to said first overspeed mechanism sensing that the downward velocity of said assembly exceeds said first predetermined value, and wherein said first device provides said first electrical signal in response to movement of said member to said actuating position.

6. Apparatus as set forth in claim 5 wherein said first device includes a first switch for generating said first electrical signal when said first overspeed mechanism actuates said first brake mechanism, wherein said second device includes a solenoid, wherein said first electrical signal energizes said solenoid, and wherein energization of said solenoid actuates said second brake mechanism.

7. Apparatus as set forth in claim 6 wherein said solenoid causes said second overspeed mechanism to actuate said second brake mechanism.

8. Apparatus as set forth in claim 7 wherein said second overspeed mechanism includes a second member movable between actuating and non-actuating positions, wherein movement of said second member to said actuating position actuates said second brake mechanism, wherein said second member moves to said actuating position in response to said second overspeed mechanism sensing that the downward velocity of said assembly exceeds said second predetermined value, and wherein energization of said solenoid in response to said first electrical signal moves said second member to said actuating position.

9. Apparatus as set forth in claim 8 wherein said second device also includes a second switch for generating said second electrical signal when said second overspeed mechanism actuates said second brake mechanism, wherein said first device also includes a solenoid, wherein said second electrical signal energizes said solenoid of said first device, and wherein energization of said solenoid of said first device moves said member of said first overspeed mechanism to said actuating position.

10. Apparatus as set forth in claim 1 wherein each of said brake mechanisms includes a brake housing, and a brake member which is supported by said brake housing and which, upon actuation of the associated brake mechanism, engages the associated mast to prevent downward movement of said brake housing relative to said associated mast.

11. Apparatus as set forth in claim 10 wherein each brake member is moveable relative to the associated brake housing between an engaged position wherein said brake member engages said associated mast and a disengaged position wherein said brake member does not engage said associated mast, wherein each brake mechanism also includes a lever which is operably connected to the associated brake member and which is movable between engaged and disengaged positions respectively corresponding to said engaged and disengaged positions of said associated brake member, and a spring biasing said lever to said lever disengaged position, and wherein the associated overspeed mechanism is operably connected to said lever.

12. Apparatus as set forth in claim 11 wherein each of said overspeed mechanisms includes a sheave, a rope reeved around said sheave and connected to said lever of the associated brake mechanism, and a stopping device for stopping rotation of said sheave and thereby stopping movement of said rope.

13. Apparatus as set forth in claim 12 wherein each of said overspeed mechanisms also includes a mounting frame, wherein said sheave is rotatably mounted on said mounting frame, and wherein said stopping device includes a member supported by said mounting frame for movement between actuating and non-actuating positions, wherein movement of said member to said actuating position stops rotation of said sheave, and wherein said member moves to said actuating position in response to said overspeed mechanism sensing that the downward velocity of said assembly exceeds a predetermined value.

14. Apparatus as set forth in claim 13 wherein said sheave has thereon a ratchet, and wherein said member includes a pawl which engages said ratchet when said member moves to said actuating position.

15. Apparatus as set forth in claim 1 and further comprising a hoist mechanism for moving said assembly vertically relative to said mast, said hoist mechanism including a hoist drum having an axis of rotation fixed relative to said masts, and a hoist rope wound around said drum and connected to said assembly.

16. Apparatus as set forth in claim 1 and further comprising a base movable along rails, and wherein said masts extend upwardly from said base.

17. Lifting apparatus comprising first and second generally vertical masts, an assembly including a frame moveable along said masts, and a load engaging mechanism mounted on said frame, a first brake mechanism which, upon actuation, engages said first mast to prevent downward movement of said frame relative to said first mast, a second brake mechanism which, upon actuation, engages said second mast to prevent downward movement of said frame relative to said second mast, a first overspeed mechanism for sensing the downward velocity of said assembly and for actuating said first brake mechanism when said overspeed mechanism senses that the downward velocity of said assembly exceeds a first predetermined value, a second overspeed mechanism for sensing the downward velocity of said assembly and for actuating said second brake mechanism when said second overspeed mechanism senses that the downward velocity of said assembly exceeds a second predetermined value, a first electrical device for providing a first electrical signal when said first brake mechanism is actuated, and a second electrical device for causing said second overspeed device to actuate said second brake mechanism in response to said electrical signal, and for providing a second electrical signal when said second brake mechanism is actuated in response to said second overspeed mechanism sensing that the downward velocity of said assembly exceeds a predetermined value, wherein said first electrical device causes said first overspeed mechanism to actuate said first brake mechanism in response to said second electrical signal.

18. Apparatus as set forth in claim 17 wherein said first device includes a first solenoid operably connected to said first overspeed mechanism such that energization of said first solenoid causes said first overspeed mechanism to actuate said first brake mechanism, and a first switch for generating a first electrical signal when said first overspeed mechanism actuates said first brake mechanism, and wherein said second device includes a second solenoid operably connected to said second overspeed mechanism such that energization of said second solenoid causes said second overspeed mechanism to actuate said second brake mechanism, and a second switch for generating a second electrical signal when said second overspeed mechanism actuates said second brake mechanism, said first signal energizing said second solenoid and thereby actuating said second brake mechanism, and said second signal energizing said first solenoid and thereby actuating said first brake mechanism.

19. Lifting apparatus comprising first and second generally vertical masts, an assembly including a frame moveable along said masts, and a load engaging mechanism mounted on said frame, a first brake arrangement which, upon actuation, prevents downward movement of said frame relative to said first mast, said first brake arrangement including a first member movable between actuating and non-actuating positions, a second brake arrangement which, upon actuation, prevents downward movement of said frame relative to said second mast, said second brake arrangement including a second member movable between actuating and non-actuating positions, a first solenoid operably connected to said first member such that energization of said first solenoid moves said first member to said actuating position, a first switch for generating a first electrical signal when said first member moves to said actuating position, a second solenoid operably connected to said second member such that energization of said second solenoid moves said second member to said actuating position, and a second switch for generating a second electrical signal when said second member moves to said actuating position, said first signal energizing said second solenoid and thereby moving said second member to actuate said second brake arrangement, and said second signal energizing said first solenoid and thereby moving said first member to actuate said first brake arrangement.

* * * * *